US005389230A

United States Patent [19]

Veluswamy

[11] Patent Number: 5,389,230

[45] Date of Patent: Feb. 14, 1995

[54] CATALYTIC HYDROCONVERSION PROCESS

[75] Inventor: Lavanga R. Veluswamy, Baton Rouge, La.

[73] Assignee: Exxon Research & Engineering Co., Florham Park, N.J.

[21] Appl. No.: 75,988

[22] Filed: Jun. 11, 1993

[51] Int. Cl.[6] ..... C10G 69/06; C10G 1/06

[52] U.S. Cl. ..... 208/68; 208/420; 208/421; 208/422; 208/423

[58] Field of Search ..... 208/68, 420, 421, 422, 208/423

[56] References Cited

U.S. PATENT DOCUMENTS

| | | | |
|---|---|---|---|
| 2,974,099 | 3/1961 | Anderson, Jr. | 208/68 |
| 3,645,885 | 2/1972 | Harris et al. | 208/8 |
| 4,077,867 | 3/1978 | Aldridge et al. | 208/10 |
| 4,295,995 | 10/1981 | Bearden et al. | 252/431 |
| 4,330,392 | 5/1982 | Bearden et al. | 208/10 |
| 4,417,972 | 11/1983 | Francis et al. | 208/10 |
| 4,485,008 | 11/1984 | Maa et al. | 208/10 |
| 4,569,751 | 2/1986 | Eidt, Jr. et al. | 208/68 |
| 4,637,870 | 1/1987 | Bearden, Jr. et al. | 208/420 |
| 4,793,916 | 12/1988 | Aldridge et al. | 208/421 |
| 4,824,558 | 4/1989 | Maa et al. | 208/420 |
| 5,064,527 | 11/1991 | Singhal et al. | 208/420 |
| 5,108,581 | 4/1992 | Aldridge et al. | 208/108 |

OTHER PUBLICATIONS

*Petroleum Refining*, Gary, James H., pp. 154–157, 1994 (month not available).

Energeia, Caer–University of Kentucky, Center for Applied Research; vol. 2, No. 2; 1991; pp. 1–8 (month not available).

*Primary Examiner*—Paul Lieberman
*Assistant Examiner*—Patricia L. Hailey
*Attorney, Agent, or Firm*—Richard D. Jordan

[57] ABSTRACT

This invention relates to a catalytic process for converting a carbonaceous material to a liquid product. More specifically, this invention relates to a process for hydroconverting coal in a hydroconverting zone to liquid hydrocarbon products in the presence of a catalyst prepared in situ, with the catalyst being added to a mixture of coal and solvent as an oil soluble metal compound. An increased quantity of liquid product is achieved by incorporating a hydrocracking zone into the process.

16 Claims, 1 Drawing Sheet

CATALYTIC HYDROCONVERSION PROCESS

FIELD OF THE INVENTION

This invention relates to a catalytic process for converting a carbonaceous material to a liquid product. More specifically, this invention relates to a process for hydroconverting coal in a hydroconverting zone to liquid hydrocarbon products in the presence of a catalyst prepared in situ, with the catalyst being added to a mixture of coal and sol vent as an oil soluble metal compound. An increased quantity of liquid product is achieved by incorporating a hydrocracking zone into the process.

BACKGROUND OF THE INVENTION

Catalytic hydroconversion of hydrocarbonaceous material to liquids, employing a liquid transfer medium such as an organic solvent, is well known. In such a process, the hydrocarbonaceous material is slurried with a solvent and a catalyst, and is reacted in the presence of molecular hydrogen at elevated temperatures and pressures. See, for example, U.S. Pat. No. 4,485,008.

Catalytic hydroconversion techniques generally produce relatively high gas yields and aromatic distillates with high heteroatom content. These types of distillate compounds generally have sulfur, nitrogen, or oxygen in the ring structure. Extensive downstream upgrading may be required in order to convert the aromatic distillates to gasoline or fuel oils and to remove heteroatoms from the products. Upgrading is expensive, however, Therefore, it is economically desirable to employ a catalytic hydroconversion procedure which reduces gas production as well as the heteroatom content of the raw liquid product.

SUMMARY OF THE INVENTION

It is an object of this invention to overcome many of the problems inherent in the prior art. In order to overcome these problems, the invention provides for a process for catalytically converting a heteroatom containing carbonaceous material to a hydroconversion product stream which comprises forming a mixture of carbonaceous material, hydrogen donor solvent, and a catalyst precursor, wherein the catalyst precursor is an oil soluble metal compound having a metal content of about 0.01–2 wt. % on the basis of the carbonaceous material and is selected from the group consisting of Groups II, III, IV, V, VIB, VIIB and VIII of the Periodic Table of Elements; converting the catalyst precursor to an active catalyst within the mixture by heating the mixture in the presence of hydrogen to form an activated catalyst mixture; reacting the activated catalyst mixture under hydrocarbon conversion conditions to form a hydroconversion product stream; separating a liquid fraction of the hydroconversion product stream, wherein the liquid fraction has an initial boiling point of about 350° F.; and hydrocracking the liquid fraction in the presence of hydrogen and a metal catalyst activated from an oil soluble metal compound, under hydrocracking conditions, wherein the metal has a concentration of about 2–20 wt. % on the basis of the liquid fraction being hydrocracked and is selected from the group consisting of Groups II, III, IV, V, VIB, VIIB and VIII of the Periodic Table of Elements, to form a hydrocracked product stream.

The present invention further provides for a process for catalytically converting a heteroatom containing carbonaceous material to a hydroconversion product stream which comprises hydroconverting the carbonaceous material in the presence of hydrogen and a metal catalyst activated from an oil soluble metal compound, under hydroconverting conditions, wherein the metal has a concentration of about 0.1–2 wt. % on the basis of the carbonaceous material and is selected from the group consisting of Groups II, III, IV, V, VIB, VIIB and VIII of the Periodic Table of Elements, to form a hydroconversion product stream; separating a liquid fraction of the hydroconversion product stream, wherein the liquid fraction has an initial boiling point of about 350° F.; and hydrocracking the liquid fraction in the presence of hydrogen and a metal catalyst activated from an oil soluble metal compound, under hydrocracking conditions, wherein the metal has a concentration of about 2–20 wt. % on the basis of the liquid fraction being hydrocracked and is selected from the group consisting of Groups II, III, IV, V, VIB, VIIB and VIII of the Periodic Table of Elements, to form a hydrocracked product stream.

BRIEF DESCRIPTION OF THE DRAWINGS

The present invention will be better understood by reference to the Description of the Preferred Embodiments when taken together with the attached drawing, wherein.

DETAILED DESCRIPTION OF INVENTION

Figure 1:
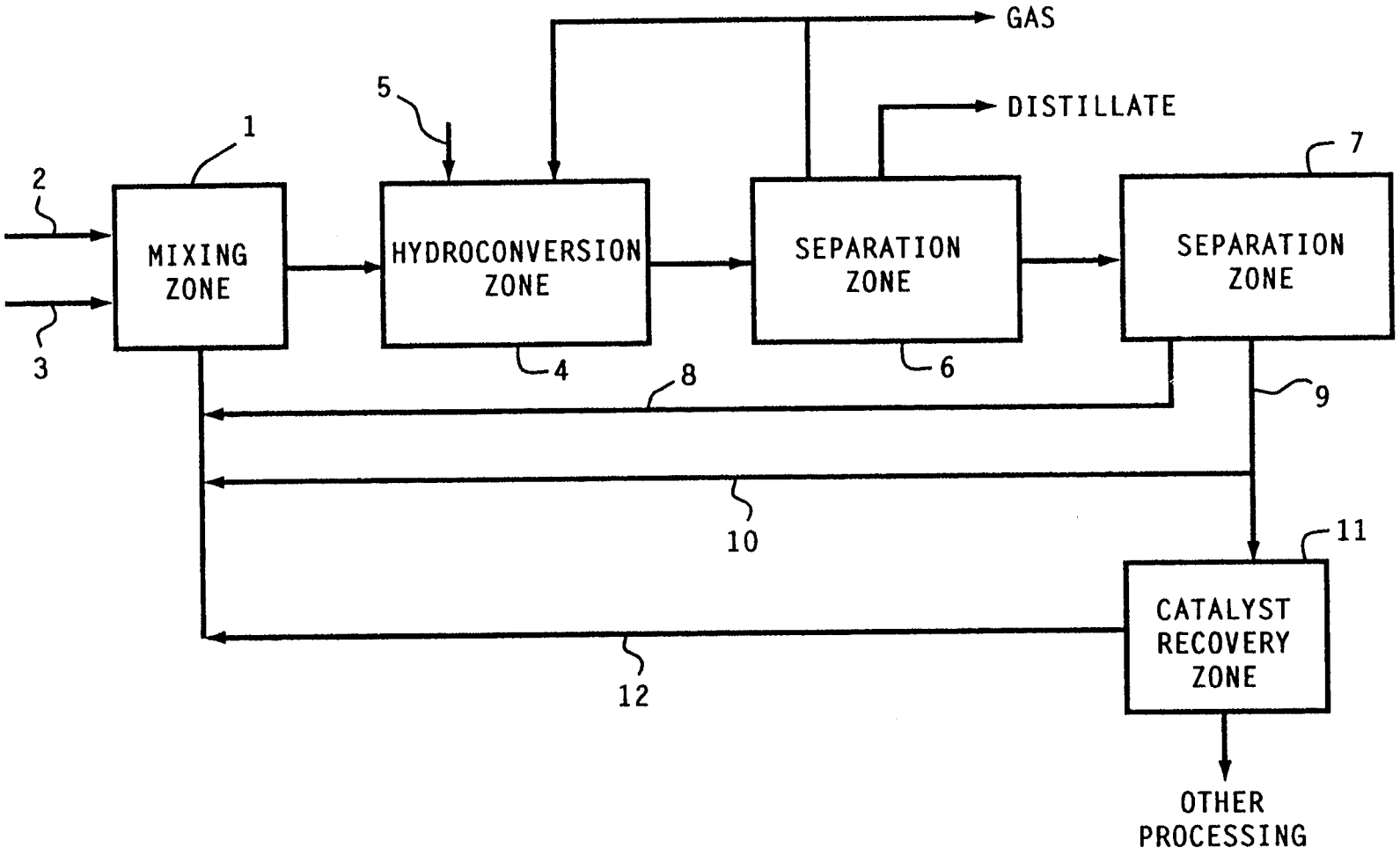
FIG. 1 is a schematic flow plan of a preferred embodiment of this invention.

The process of the invention is generally applicable, but not limited to, the hydroconversion of heteroatom containing carbonaceous feeds such as heavy hydrocarbonaceous oils having constituents boiling above about 900° F., coal and mixtures thereof. Suitable heavy hydrocarbonaceous oil feeds include heavy mineral oils; crude petroleum oils, including heavy mineral oils; residual oils such as atmospheric residuum and vacuum residuum; tar; bitumen; tar sand oils; shale oils; liquid products derived from coal liquefaction processes, including coal liquefaction bottoms, and mixtures thereof. The process is also applicable for the simultaneous conversion of mixtures of coal and a hydrocarbonaceous oil.

The term "coal" as used herein refers to a normally solid carbonaceous material such as anthracite, bituminous coal, sub-bituminous coal, lignite and mixtures thereof. All boiling points referred to herein are atmospheric pressure boiling points unless otherwise specified.

In the hydroconversion of coal, the coal is preferably mixed with a hydrogen donor solvent. The hydrogen donor solvent employed is preferably an intermediate stream which boils between about 350° F. and 1000° F., preferably between about400° F. and about 900° F. This stream comprises hydrogenated aromatics, naphthenic hydrocarbons, phenolic materials and similar compositions. These compositions preferably include at least about 20 wt. %, preferably at least about 50 wt. %, compounds which function as hydrogen donors under typical hydroconversion conditions. Such hydroconversion conditions are well known in the art. Compounds which are acceptable as hydrogen donor solvents include hydrogenated creosote oil, hydrogenated intermediate product streams from catalytic cracking of petroleum feedstocks, and other coal-derived liquids which are rich in indane, $C_{10}$–$C_{12}$ tetralins, decalins, biphenyls, methylnaphthalene, dimethylnaphthalene, $C_{12}$–$C_{13}$ acenaphthenes and tetrahydroacenaphthene and similar donor compounds.

When the process is used to hydroconvert coal, the coal is preferably provided in particulate form. The coal particles preferably are of a size which range up to about one eighth inch in diameter, suitably 8 mesh (Tyler). The coal particles and hydrogen donor solvent are preferably mixed at a solvent-to-coal weight ratio of about 1–5 to 1, more preferably about 1.5-2 to 1.

The catalyst of this invention is preferably converted to an active metal catalyst from an oil-soluble metal compound or dispersible metal compound. The metal compound may be a compound that is soluble in a hydrocarbonaceous oil or a compound that is soluble in a liquid organic medium that can be dispersed in the hydrocarbonaceous oil. The metal compound may also be a compound that is water soluble, and an aqueous solution of the compound can be dispersed in the hydrocarbonaceous medium.

Preferably, the catalyst of this invention is an active metal catalyst that has been converted from a metal-containing, oil-dispersible compound under process conditions. Suitable oil-soluble compounds which are convertible to active metal-containing catalysts under process conditions include (1) metal-containing inorganic compounds such as metal-containing halides, oxyhalides, hydrated oxides, heteropoly acids (e.g., phosphomolybdic acid, molybdosilisic acid); (2) metal salts of organic acids such as acyclic and alicyclic aliphatic carboxylic acids containing two or more carbon atoms (e.g., naphthenic acids); aromatic carboxylic acids (e.g., toluic acid); sulfonic acids (e.g., toluenesulfonic acid); sulfinic acids; mercaptans, xanthic acid; phenols, di and polyhydroxy aromatic compounds; (3) metal-containing organometallic compounds including metal-containing chelates such as 1,3-diketones, ethylene diamine, ethylene diamine tetraacetic acid, phthalocyanines, etc.; and (4) metal salts of organic amines such as aliphatic amines, aromatic amines, and quaternary ammonium compounds.

The metal constituent of the oil dispersible or oil soluble metal compound that is convertible to a solid, metal-containing catalyst is selected from the group consisting of Groups II, III, IV, V, VIB, VIIB and VIII, and mixtures thereof of the Periodic Table of the Elements. Non-limiting examples include zinc, antimony, bismuth, titanium, cerium, vanadium, niobium, tantalum, chromium, molybdenum, tungsten, manganese, rhenium, iron, cobalt, nickel and the nobel metals including platinum, iridium, palladium, osmium, ruthenium, and rhodium. The preferred metal constituent of the oil dispersible compound is selected from the group consisting of molybdenum, tungsten, vanadium, chromium, cobalt, titanium, iron, nickel and mixtures thereof. Preferred compounds of the given metals include the salts of acyclic (straight or branch chained) aliphatic carboxylic acids, salts of cyclic aliphatic carboxylic acids, polyacids, carbonyls, phenolates and organoamine salts.

The Periodic Table of the Elements referred to herein is published by Sargent-Welch Scientific Company, copyright 1979, available as catalog no. S-18806. Oil dispersible metal compounds which can be used in this invention are also described in U.S. Pat. No. 4,295,995, the teachings of which are incorporated herein by reference. The preferred oil dispersible metal compounds are inorganic polyacids of metals selected from Groups VA, VIA, and mixtures thereof. Included in this group are vanadium, niobium, chromium, molybdenum, tungsten and mixtures thereof. Suitable inorganic polyacids include phosphomolybdic acid, phosphotungstic acid, phosphovanadic acid, silicomolybdic acid, silicotungstic acid, silicovanadic acid and mixtures thereof. The preferred polyacid is a phosphomolybdic acid. The terms "heteropolyacids" and "isopolyacids" are used in accordance with the definitions given in *Advanced Inorganic Chemistry,* 4th Edition, S. A. Cotton and Geoffrey Wilkinson, Interscience Publishers, N.Y., pages 852–861.

Another preferred oil soluble metal compound is a salt of an alicyclic aliphatic carboxylic acid such as the metal naphthenate. Other preferred types of oil soluble metal compounds are metal containing heteropoly acids, e.g., phosphomolybdic acid, as well as oil soluble and/or highly dispersible molybdenum complexes such as:

$$MoO_2(S_2CNR_2)_2 \quad (R_1)$$

where $R_1$ and $R_2$ can be the same or different and each can be a $C_1$ to $C_{18}$ alkyl group, a $C_5$ to $C_8$ cycloalkyl group, a $C_6$ to $C_{18}$ alkyl substituted cycloalkyl group, or a $C_6$ to $C_{18}$ aromatic or alkyl substituted aromatic group, or $$Mo_2O_2(\mu\text{-}S)_2(S_2CNR_2)_2 \quad (R_1)$$

where $R_1$ and $R_2$ are as indicated above, and $\mu$-S denotes a sulfide ($S^{2-}$) ligand bridging the two molybdenum atoms, or any related complex of molybdenum with dithiocarbamate, dithiophosphate, xanthates, or thioxanthate ligands.

In another preferred embodiment of the present invention, the molybdenum complex is dioxobis(n-dibutyldithiocarbamato)$MoO_2$, generally referred to as dioxoMoDTC.

In still other preferred embodiments of the invention, the molybdenum complex is $$Mo_2O_2(\mu\text{-}S)_2(S_2CNR_2)_2, \quad (R_1)$$

where R1 and R2 are n-butyl.

Other metal compositions which are useful in this invention include the compounds $(C_2H_5OCH_2CH_2OCS_2)_{Ni\ and}\ (C_2H_5OCH_2CH_2OCS_2)_2$ Pt. These compounds are generally referred to as NiEEX and PtEEX, respectively.

Although Mo may be used alone as the metal component of the catalyst in the hydroconversion process, it is often promoted with certain metals in upgrading operations such as hydrotreating and hydrocracking. Such metals include Ni, Co, Cu, Pt, Pd and Sn. These metals have been found to have a promoting effect on Mo, increasing liquid yields and cracking selectivity at high catalyst concentrations as well as reducing the presence of heteroatoms such as S and N.

In the instant invention, the catalyst preferably comprises Mo or Mo promoted with Ni, Co, Cu, Pt, Pd or Sn. Preferably, the catalyst metal will comprise Mo and Ni at a molar ratio of between about 2:1 and 4:1, more preferably about 3:1. The total concentration of metal on the basis of carbonaceous material will be about 0.01–2 wt. %.

The oil-soluble metal compound or dispersible metal compound used in this invention is preferably dissolved in a hydrogen donor solvent and slurried with the carbonaceous material, preferably coal. At this stage, the metal compound is actually considered a catalyst precursor and should be activated to proceed with the hydroconversion process, which typically takes place in a hydroconversion zone. The catalyst precursor is preferably mixed with the solvent at a solvent to catalyst precursor ratio of about 1–2 to 1, more preferably about 1.6 to 1.

Various methods can be used to convert the catalyst precursor to an active catalyst. A preferred method of activating the catalyst precursor is to heat the mixture of catalyst precursor, carbonaceous material and solvent to a temperature ranging from about 600° F. to 1000° F., at a pressure ranging from about 500 psig to 5000 psig, in the presence of a hydrogen-containing gas. The hydrogen-containing gas can be molecular hydrogen or a hydrogen donating gas such as hydrogen sulfide. The activation process can be performed prior to entering the hydroconversion zone, or the hydroconversion zone can be used for both activating the catalyst and hydroconverting the carbonaceous feed material to form the hydroconversion products.

In typical hydroconversion processes, a liquid fraction of the hydroconversion product is used as the hydrogen donor solvent. Hydroconversion product quality is improved in the process of this invention, however, by improving the quality of hydrogen donor solvent.

In the present invention, the products of the hydroconversion reaction are separated into gas, liquid and solid component parts. A significant portion of the the liquid component, approximately a 350°–1000° F. distillate fraction, is separately recovered and catalytically hydrocracked. The catalyst used in the hydrocracking step is the same type of activated metal catalyst used in the hydroconversion step, except that the total concentration of metal catalyst, on the basis of carbonaceous material, in the hydrocracking step is preferably about 2–20 wt. %, more preferably about 5–10 wt. %, The hydrocracking step results in an overall product stream having a significant portion of light and middle distillate relative to known processes. The sulfur, nitrogen and oxygen content of the distillate is also significantly improved.

After the hydrocracking step, the hydrocracked product stream which is formed is separated into separate gas, and low and high boiling point liquids component streams. Preferably, a hydrocracked distillate fraction having an initial boiling point of about 350° F. is separated from the hydrocracked product stream and is recycled for use as the hydrogen donor solvent in the hydroconversion reaction. Using the hydrocracked product fraction as the hydrogen donor solvent results in a total product stream which has an increased liquid product yield and has a lower heteroatom concentration relative to typical hydroconversion processes.

One embodiment of the present invention is shown in FIG. 1 in which a carbonaceous material such as particulate coal is added to a mixing zone 1. Catalyst precursor is also added to the mixing zone 1, and the catalyst precursor and carbonaceous material are slurried with a hydrogen donor solvent. After slurrying, the mixture is passed to a hydroconversion zone 4. Within the hydroconversion zone 2, a hydrogen gas is added to the mixture through line 3 under hydroconversion conditions. It is not necessary, however, that the hydrogen gas be added at the hydroconversion zone 2. It can be added prior to the hydroconversion zone 2, if it is so desired.

Under typical hydroconversion conditions, the hydroconversion zone 2 is maintained at a temperature ranging from about 600°–1000° F., preferably from about 700°–900° F. The hydrogen partial pressure within the hydroconversion zone 2 will preferably range from about 500 psig to 5000 psig, more preferably from about 1000 psig to 3000 psig. Preferably, the residence time in the hydroconversion zone 2 will be about 0.1 minute to 8 hours, more preferably about 30–160 minutes.

The hydroconversion product is removed from the hydroconversion zone 2, and sent to a separation zone 4 for separation into separate component product streams. The hydroconversion product stream comprises a combination of gas, liquid, and solid component streams at standard conditions. Gas and low boiling point liquids are preferably removed from the separation zone 5 as overhead streams. The separation zone 4 is preferably operated at standard flash conditions. Typically, the products of the hydroconversion zone 2 are flashed in the separation zone 4 at reduced pressure and at a temperature of about 400°–800° F.

The gas component stream removed from separation zone 4 comprises components having a boiling point of less than about 80° F. This stream includes compounds such as CO, $CO_2$, $H_2S$, and $C_1$–$C_4$ paraffins and olefins. The gas stream can be recovered as a separate product or a portion of the gas stream can be recycled to the hydroconversion zone 2, since the gas stream will typically contain a high concentration of a hydrogen gas which can be used as a hydrogen gas supply for the hydroconversion zone 2. The gas stream can also be scrubbed by conventional methods before or after the recycle location. Preferably, the gas stream is scrubbed before storing in an off-site facility. Scrubbing can be used to reduce the content of hydrogen sulfide or carbon dioxide.

The low boiling point liquid that is removed from the separation zone 4 can be recovered as a separate fuel product. It is preferred that this product be a distillate having a final boiling point of less than about 400° F., more preferably a naphtha stream having a boiling point of about 80°–350° F.

As shown in FIG. 1, a "wide cut" liquid product of the hydroconversion reaction is preferably removed from the separation zone 4 by way of line 5, and the wide cut liquid is sent to a hydrocracking zone 6. The wide cut liquid product is preferably a distillate fraction which has a boiling point of about 350°–1000° F.

The solid component stream which is removed from separation zone 4 is typically referred to as a "bottoms" stream and includes not only solid carbonaceous material, but a heavy distillate fraction from the hydroconversion reaction which has a boiling point of at least about 1000° F. A significant portion of the catalyst that has passed through the hydroconversion zone 2 is also included in the bottoms stream. Because the catalyst constitutes a significant portion of the bottoms stream, and there is a significant amount of unreacted hydrocarbon that can be further reacted, a portion of the bottoms stream can be recycled to the hydroconversion zone 2. As shown i n FIG. 1, a portion of the bottoms stream is recycled to the mixing zone i through a line 7. Preferably, a recycle ratio rate will be used to establish a solvent to coal to solids ratio of about 0.5–3 to 1 to 0.1–2, more preferably about 1 to 1 to 1. The unused portion can be processed to recover hydrogen, and the catalyst metals can be reclaimed if economically feasible.

Within the hydrocracking zone 6, the wide cut liquid is contacted with catalyst and a hydrogen gas, under hydrocracking conditions to form a hydrocracked product reaction stream. The catalyst is preferably an active metal catalyst prepared from an oil soluble or oil dispersible metal compound having a metal content in the hydrocracking zone 6, on the basis of the wide cut liquid, of about 2–20 wt. %, more preferably about 5–10 wt. %. The hydrocracking reaction is preferably carried out within the hydrocracking zone 6 under typical hydrocracking conditions. Preferably, the hydrocracking zone 6 will operate at a temperature of about 700°–900° F. and a residence time of about 5 minutes to 6 hours. The hydrogen gas can be molecular hydrogen or a hydrogen donating gas such as hydrogen sulfide, and is preferably added to the hydrocracking zone 6 through a line 8 at a hydrogen partial pressure of about 1000–3000 psig.

The hydrocracked reaction products are removed from the hydrocracking zone 6, and sent to a separation zone 9 for separation into separate component product streams. The hydrocracked reaction products comprise some gas as well as low and high boiling point liquid components as a result of the hydrocracking reaction. The gas and low boiling point liquids can be separated within the separation zone 9 as desired. The separation zone 9 can be operated under flash conditions or under vacuum depending upon the specific composition of the component streams that is desired. Preferably, the gas and liquids which have a boiling point of less than about 350° F. are removed together as a light ends distillate fraction. The liquid portion of the light ends fraction typically includes naphtha.

If desired, a middle distillate stream can also be recovered from the separation zone 9. This middle distillate is preferably a distillate stream having a boiling point of about 350°–650° F. Such a boiling point liquid is typically a diesel fuel or fuel oil composition.

It is highly desirable to recover a wide cut middle and high boiling point distillate fraction from the separation zone 9 to use as the hydrogen donor solvent in the hydroconversion reaction. Preferably, the wide cut distillate solvent has an initial boiling point of about 350° F. As shown i n FIG. 1, the wide cut distillate sol vent can be used as the hydrogen donor solvent in the hydroconversion reaction by recycling the distillate through a recycle line 10 into the mixing zone 1.

Preferably, a portion of the hydrocracked product reaction stream which is separated in the separation zone 9 is recycled back to the hydrocracking zone 6. As shown in FIG. 1, the recycle can be by way of line 11 to line 5, or if preferred, line 11 can be used for direct recycle into the hydrocracking zone 6. Preferably, the recycle stream is a high boiling point distillate stream having an initial boiling point of at least about 900° F., more preferably an initial boiling point of at least about 650° F. The purpose of the recycle stream is to return unconverted carbonaceous material for further hydrocracking, and to return any catalyst which leaves the hydrocracking zone 6 along with the hydrocracked product.

Having now generally described this invention, the same will be better understood by reference to certain specific examples which are included herein for purposes of illustration only and are not intended to be limiting of the invention, unless otherwise specified.

EXAMPLE 1

Comparative experiments are conducted according to known operations procedures (Run 1) and using a hydrocracking zone according to the process of this invention (Run 2). Particulate Illinois-Monterrey coal and wide cut coal distillate having a boiling point of about 400°–1000° F. are continuously reacted in the presence of a preformed catalyst in a hydroconversion reactor at a solvent to coal ratio of 1.6/1. The catalyst is a Mo catalyst activated from an oil soluble metal compound, dioxoModithiocarbamate, which is maintained at a concentration of 500 PPM in the reactor. The reaction is carried out at 775° F. for 240 minutes under a hydrogen partial pressure of 2000 psig. The wide cut coal distillate used in Run 1 is recovered from a flash separation vessel which is used to separate the hydroconversion product from the hydroconversion reactor. The hydrogenated wide cut coal distillate used in Run 2 is recovered from a hydrocracking reactor in which a 350°–1000° F. distillate fraction from the hydroconversion reactor is hydrocracked. The hydrocracking reactor reaction is carried out at 800° F. for 240 minutes at a 2000 psig hydrogen partial pressure. The catalyst concentration in the hydrocracking reactor is a 5 wt. % activated metal catalyst that is a combination of Ni and Mo, prepared from an oil soluble metal compound, NiEEX and dioxoModithiocarbamate. The bottoms portion of the hydroconversion product was not recycled in either Run. The results are shown in Table 1.

TABLE 1

| | Run 1 | Run 2 |
|---|---|---|
| H/C ratio of solvent | 1.05 | 1.4 |
| Product Composition | wt % | |
| Chem gas | 3.2 | 4.2 |
| $C_1$–$C_4$ | 8.8 | 7.9 |
| $C_5$- 400° F. | 8.5 | 13.0 |
| 400–650° F. | 13.7 | 13.4 |
| 650–1000° F. | 17.2 | 17.6 |
| Conversion to liq, fraction | 56.2 | 61.1 |

EXAMPLE 2

The comparative procedure of Example 1 is repeated, except that in both runs, bottoms conversion product from the hydroconversion zone was recovered and recycled at a solvent to coal to bottoms ratio of 1/1/1. Vacuum gas oil (VGO, 650°–1000° F.) is recycled to the hydroconversion zone in Run 1 for complete conversion. In Run 2, VGO from the hydroconversion zone is completely converted in the hydrocracking zone. The results are shown in Table 2.

TABLE 2

| | Run 1 | Run 2 |
|---|---|---|
| H/C ratio of solvent | 1.05 | 1.4 |
| Product Composition | wt % | |
| Chem gas | 5.0 | 5.0 |

TABLE 2-continued

| | Run 1 | Run 2 |
|---|---|---|
| $C_1$–$C_4$ | 15.4 | 12.3 |
| $C_5$- 400° F. | 16.4 | 25.2 |
| 400–650° F. | 36.6 | 33.8 |
| 650–1000° F. | — | — |
| Conversion to liq, fraction | 78.4 | 81.3 |
| N, PPM in liq. fraction | 10000 | 75 |
| S, PPM in liq. fraction | 2300 | 35 |
| 0, PPM in liq. fraction | 28000 | 4300 |

Having now fully described this invention, it will be appreciated by those skilled in the art that the same can be performed within a wide range of equivalent parameters of compositions and conditions without departing from the spirit or scope of the invention or any embodiment thereof.

What is claimed is:

1. A process for catalytically converting a heteroatom containing carbonaceous material to a hydroconversion product stream comprising sequentially forming a mixture of carbonaceous material, hydrogen donor solvent, and a catalyst precursor, wherein the catalyst precursor is an oil soluble or oil dispersible metal compound having a metal content of about 0.01–2 wt. % on the basis of the carbonaceous material and is selected from the group consisting of Groups II, III, IV, V, VIB, VIIB and VIII of the Periodic Table of Elements;

converting the catalyst precursor to an active catalyst within the mixture by heating the mixture in the presence of hydrogen to form an activated catalyst mixture;

reacting the activated catalyst mixture under hydrocarbon conversion conditions to form a hydroconversion product stream;

separating a liquid fraction of the hydroconversion product stream, wherein the liquid fraction has an initial boiling point of about 350° F.; and thereafter hydrocracking the liquid fraction in the presence of hydrogen and a metal catalyst activated from an oil soluble or oil dispersible metal compound, said activated metal catalyst being essentially the same activated metal catalyst used in the hydroconversion step, under hydrocracking conditions, wherein the metal has a concentration of about 2–20 wt. % on the basis of the liquid fraction being hydrocracked and is selected from the group consisting of Groups II, III, IV, V, VIB, VIIB and VIII of the Periodic Table of Elements, to form a hydrocracked product stream.

2. The process of claim 1, wherein a distillate fraction having an initial boiling point of about 350° F. is separated from the hydrocracked product stream and recycled as the hydrogen donor solvent

3. The process of claim 1, wherein the carbonaceous material is selected from the group consisting of anthracite, bituminous coal, subbituminous coal, lignite, and mixtures thereof.

4. The process of claim 1, wherein the metal of the hydroconversion and hydrocracking steps is selected from the group consisting of Mo, Ni, Co, Cu, Pt, Pd and Si.

5. The process of claim 1, wherein the metal of the hydroconversion and hydrocracking steps is Mo promoted with Ni, Co, Cu, Pt, Pd or Sn.

6. The process of claim 1, wherein the oil soluble metal compound of the hydroconversion and hydrocracking steps is dissolved in a hydrogen donor solvent and heated to a temperature ranging from about 600° F. to 1000° F., at a pressure ranging from about 500 psig to 5000 psig, in the presence of a hydrogen gas to form the activated metal catalyst.

7. The process of claim 6, wherein the oil soluble metal compound and the hydrogen donor solvent are dissolved at a solvent to oil soluble metal ratio of about 1–2 to 1.

8. The process of claim 6, wherein the hydrogen gas is molecular hydrogen or a hydrogen donating gas.

9. A process for catalytically converting a heteroatom containing carbonaceous material to a hydroconversion product stream comprising sequentially hydroconverting the carbonaceous material in the presence of hydrogen and a metal catalyst activated from an oil soluble or oil dispersible metal compound, under hydroconverting conditions, wherein the metal has a concentration of about 0.1–2 wt. % on the basis of the carbonaceous material and is selected from the group consisting of Groups II, III, IV, V, VIB, VIIB and VIII of the Periodic Table of Elements, to form a hydroconversion product stream;

separating a liquid fraction of the hydroconversion product stream, wherein the liquid fraction has an initial boiling point of about 350° F.; and thereafter hydrocracking the liquid fraction in the presence of hydrogen and a metal catalyst activated from an oil soluble or oil dispersible metal compound, said activated metal catalyst being essentially the same activated metal catalyst used in the hydroconversion step, under hydrocracking conditions, wherein the metal has a concentration of about 2–20 wt. % on the basis of the liquid fraction being hydrocracked and is selected from the group consisting of Groups II, III, IV, V, VIB, VIIB and VIII of the Periodic Table of Elements, to form a hydrocracked product stream.

10. The process of claim 9, wherein a distillate fraction having an initial boiling point of about 350° F. is separated from the hydrocracked product stream and recycled as the hydrogen donor solvent

11. The process of claim 9, wherein the carbonaceous material is selected from the group consisting of anthracite, bituminous coal, subbituminous coal, lignite, and mixtures thereof.

12. The process of claim 9, wherein the metal of the hydroconversion and hydrocracking steps is selected from the group consisting of Mo, Ni, Co, Cu, Pt, Pd and Si.

13. The process of claim 9, wherein the metal of the hydroconversion and hydrocracking steps is Mo promoted with Ni, Co, Cu, Pt, Pd or Sn.

14. The process of claim 9, wherein the oil soluble metal compound of the hydroconversion and hydrocracking steps is dissolved in a hydrogen donor solvent and heated to a temperature ranging from about 600° F. to 1000° F., at a pressure ranging from about 500 psig to 5000 psig, in the presence of a hydrogen gas to form the activated metal catalyst.

15. The process of claim 14, wherein the oil soluble metal compound and the hydrogen donor solvent are dissolved at a solvent to oil soluble metal ratio of about 1–2 to 1.

16. The process of claim 14, wherein the hydrogen gas is molecular hydrogen or a hydrogen donating gas.

* * * * *